US006669331B2

(12) United States Patent
Teshigawara et al.

(10) Patent No.: US 6,669,331 B2
(45) Date of Patent: Dec. 30, 2003

(54) INK JET PRINT APPARATUS, INK JET PRINTING METHOD, PROGRAM, AND COMPUTER-READABLE STORAGE MEDIUM THAT STORES THE PROGRAM

(75) Inventors: Minoru Teshigawara, Kanagawa (JP); Naoji Otsuka, Kanagawa (JP); Kiichiro Takahashi, Kanagawa (JP); Osamu Iwasaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 1 day.

(21) Appl. No.: 10/127,471

(22) Filed: Apr. 23, 2002

(65) Prior Publication Data

US 2002/0171709 A1 Nov. 21, 2002

(30) Foreign Application Priority Data

May 15, 2001 (JP) ..... 2001-145227
Mar. 6, 2002 (JP) ..... 2002-060165

(51) Int. Cl.[7] ..... B41J 2/21
(52) U.S. Cl. ..... 347/43; 347/15; 347/19
(58) Field of Search ..... 347/15, 43, 14, 347/19, 41; 358/1.9, 1.2, 502

(56) References Cited

U.S. PATENT DOCUMENTS 6,007,181 A 12/1999 Takahashi et al. ..... 347/41
6,089,697 A * 7/2000 Tajika et al. ..... 347/43
6,102,511 A 8/2000 Shioya et al. ..... 347/9
6,213,584 B1 4/2001 Noyes et al. ..... 347/40

FOREIGN PATENT DOCUMENTS

| | | |
|---|---|---|
| EP | 0 475 696 | 3/1992 |
| EP | 1046510 A2 | 10/2000 |
| EP | 1046510 A3 | 10/2000 |
| JP | 5-220947 | 8/1993 |

* cited by examiner

*Primary Examiner*—Lamson Nguyen

(57) ABSTRACT

A print apparatus that, without significantly reducing an overall printing speed, allows a reduction in uneven densities due to the discharge time difference between black ink and color inks, which occur particularly at both ends in a scanning range and which are caused by the printing by bidirectional scanning of print heads, and enables high image-quality printing to be realized. In this print apparatus, one band is divided into plural areas in a main scanning direction, the dot numbers of black ink and color ink imparted to respective areas are counted. If there are any areas where the dot numbers of both black and color exceed respective threshold values, the area number is counted, and if the number exceeds a predetermined number, the print mode is switched from bidirectional printing to a unidirectional one, upon determining that there is a high probability of occurrence of the above-described uneven densities.

17 Claims, 9 Drawing Sheets

| AREAS | TIME DIFFERENCE BETWEEN PREDISCHARGE (BLACK) AND POSTDISCHARGE (COLORS) | DENSITY |
|---|---|---|
| A C E | LARGE | THICK |
| B D F | SMALL | THIN |

INK JET PRINT APPARATUS, INK JET PRINTING METHOD, PROGRAM, AND COMPUTER-READABLE STORAGE MEDIUM THAT STORES THE PROGRAM

BACKGROUND OF THE INVENTION

1. Field of the Invention

The present invention relates to an ink jet print apparatus, and an ink jet printing method. More particularly, the present invention relates to an ink jet print apparatus, an ink jet printing method, program controlling the apparatus, and a storage medium storing the program that allow a reduction in uneven colors due to the difference in recording time between recording black inks and color inks, the time difference being caused by performing printing by bidirectional scanning of recording heads.

2. Description of the Related Art

In ink jet type print apparatuses, when performing color printing on a commonly-used print medium such as plain paper, it has been difficult to achieve an improvement in recording speed and an enhancement of image quality.

Methods for improving the recording speed that have been used include a method where the size of the region recordable by one scan is increased by lengthening the recording head; a method where the recording (driving) frequency of recording heads is increased; and a method where the printing is performed by bidirectional scanning of the recording heads. Among these methods, the "bidirectional printing" method is a cost-effective method as a total system, since the energy required for obtaining a given throughput is dispersed over time, as compared to the case where printing is performed by unidirectional scanning, i.e., unidirectional printing.

When performing such bidirectional printing, the discharge order of black ink and color inks constituting a pixel differs between the advance and return scanning directions of the recording heads. This is because the discharge ports (hereinafter referred to as nozzles) for the black ink and color inks are arranged in the scanning direction, and the discharging order for the black ink and color inks determined by this arranging manner is different between the advance direction and the return direction. When the discharge order of black ink and color inks is different, a difference in the hue can occur between the region recorded in the advance direction scanning and the region recorded by the return direction scanning, thereby causing degradation in the image quality. For example, band-like uneven colors may occur over an entire printed color image, which causes the poor image quality. As coutermeasures against this, for example, Japanese Patent Application Publication No. 11-313790 proposes a method for eliminating the above-described uneven colors by configuring a head where rows of nozzles of black ink and color inks are disposed symmetrically with respect to the scanning direction thereof.

On the other hand, the present invention uses a high image quality when printing a text and the like on plain paper, an ink jet print device using a pigment-based black ink is being provided. This arrangement especially allows black letters to be improved in quality and density.

In this arrangement, such a pigment-based black ink is frequently provided with a composition that is relatively impermeable with respect to paper in order to prevent ink from permeating along fabrics of paper. Such an arrangement is referred to as feathering. Also, recording heads are frequently used that have a configuration where black ink nozzles and color ink nozzles are arranged in a direction substantially perpendicular to the scanning direction of the recording heads. In the case of the configuration where the nozzles discharging a black ink, which has a low permeability, and the nozzles discharging color inks, which have a high permeability such as to exhibit a permeability value higher than a predetermined value (hereinafter, ink with a high permeability is referred to as a "super-permeable ink") are arranged along the scanning direction (such an arrangement is referred to as a lateral nozzle-arrangement), an imparting time difference between a black ink and color inks is small since the black ink and color inks are imparted to the same scanning region during one scan when printing is performed on a predetermined region. As a result, for example, when printing a black shade pattern on a print region with a yellow color, bleeding occurs at a boundary portion of the region where printing is performed with a black ink and the region where printing is performed with color inks, or when printing a pattern where a high-density black patch is fringed with a yellow color, a so-called white haze phenomenon can occur, which indicates a reduction in the density due to the retreat of the ink with a low permeability. In order to reduce the above-described bleeding and white haze, recording heads where black nozzles and color nozzles are arranged to be offset along a direction perpendicular to the scanning direction (such an arrangement is referred to as a longitudinal nozzle-arrangement) are frequently used.

However, when colors where a black ink dot and color ink dots are intermingled, such as a gray color, are to be printed by bidirectional printing using the recording heads with the above-described longitudinal nozzle-arrangement, the discharge times between the black ink and the color inks are different, at the right and left ends in each scanning region. This raises a problem that, particularly at the above-described two ends, even if the color is a given gray, a difference in the hue will occur in each scanning region (hereinafter referred to as band). Consequently, a streak-like uneven color can occur for each band over the entire paper on which the printing is performed.

In the above-described longitudinal nozzle-arrangement, during scanning of the recording head, respective scanning regions to which black ink nozzles and color ink nozzles correspond, are different from each other. Therefore, the black ink nozzle corresponds to a predetermined scanning region during an earlier scanning (a first scanning), and the color ink nozzle corresponds to the predetermined scanning region during a later scanning (a second scanning), or conversely, the color ink nozzle corresponds to the predetermined scanning region during an earlier scanning (the first scanning), and the black ink nozzle corresponds to the predetermined scanning region during a later scanning (the second scanning). Consider, for example, a case where the black ink nozzle corresponds to the predetermined scanning region during the first scanning in the advance direction (e.g., a scanning from the left to the right), and the color ink nozzle corresponds to the predetermined scanning region during the second scanning in the return direction (e.g., a scanning from the right to the left). In this case, with respect to the right end of the above-described predetermined scanning region, the black ink is discharged at the end of the first scanning in the advance direction, and the color ink is discharged at the beginning of the second scanning in the return direction, the second scanning being performed immediately after the first scanning. As a consequence, the discharge time difference between the black ink and each of the color inks becomes small. On the other hand, with respect to the left end of the above-described predetermined scanning region, the black ink is discharged at the beginning of the first scanning in the advance direction, and the color ink is discharged at the end of the second scanning in the return direction, the second scanning being performed immediately after the first scanning. As a result, the discharge time difference between black and color inks becomes large. That is, when performing bidirectional printing using the head with the above-described longitudinal nozzle-arrangement, there occur a portion where the black ink is discharged by the black ink nozzle at the end of the scanning and where, upon the change of scanning direction immediately after the above-described discharging, the color ink is discharged from the color ink nozzle, and a portion where the black ink is discharged by the black ink nozzle at the beginning of the scanning and where, after about one round trip of the above-described scanning, the color ink is discharged from the color ink nozzle, thereby producing the above-described time difference.

For example, when a black ink with a low permeability is earlier discharged and thereafter super-permeable color inks are discharged, the black ink is pressed into the paper and the density thereof decreases, since the color inks are dotted before the black ink has been dotted and permeated through the paper. Therefore, even if, at the right end and the left end of the paper, printing is performed by the same order and the same discharge amount, a density difference will be caused by the above-described time difference. If the density difference by the time difference occurs in one band, the density difference will be difficult to be visually recognized since the degree of density difference gradually changes along the scanning direction of the recording head. However, if the density difference continuously occurs in several bands over the entire paper, the largeness and smallness of the above-described time difference will be repeated for each band particularly at the left and right ends, and the density difference between the bands will become visually noticeable, thereby causing a degradation in the image quality.

SUMMARY OF THE INVENTION

Accordingly, it is an object of the present invention to solve the above-described conventional problems and to provide an ink jet print apparatus, printing method, program controlling the apparatus, and a storage medium storing the program that allows high image-quality printing to be realized without a significant reduction in overall printing speed, by judging the probability of occurrence of uneven color due to the above-described time difference, and by selectively using the bidirectional printing and unidirectional printing based on the above-mentioned judgement.

In order to achieve the above-described object, the present invention provides an ink jet print apparatus capable of a bidirectional printing mode where printing is performed on a print medium by both a main scan in an advance direction and a main scan in a return direction of print heads for discharging a plurality of different kinds of inks, and capable of a unidirectional printing mode where printing is performed on the print medium by either the main scan in the advance direction or the main scan in the return direction of the print heads. This apparatus comprises acquiring means that, based on print data corresponding to a predetermined region on the printing medium, acquires information of respective ink amounts to be imparted to the predetermined region for the plurality of different kinds of inks; determining means that, based on the above-described information acquired by the acquiring means, determines whether the respective imparting amounts of the plurality of different kinds of inks exceed respective predetermined amounts that have been predetermined corresponding to the respective inks. Herein, (a) when the determining means determines that the respective imparting amounts of all of the plurality of different kinds of inks exceed the respective predetermined amounts, printing with respect to the predetermined region is performed in the unidirectional print mode; and (b) when the determining means determines that at least one of the respective imparting amounts of the plurality of different kinds of inks does not exceed the predetermined amount thereof, printing with respect to the predetermined region is performed in the bidirectional print mode.

Also, the present invention provides an ink jet printing method where printing is performed in any one of a bidirectional printing mode in which printing is performed on a print medium by both a main scan in an advance direction and that in a return direction of print heads for discharging a plurality of different kinds of inks, and a unidirectional printing mode in which printing is performed on the print medium by one of the main scan in the advance direction and the main scan in the return direction of the print heads. This method comprising the step of acquiring, based on print data corresponding to the predetermined region on the print medium, information of respective ink amounts to be imparted to the predetermined region for the plurality of different kinds of inks; and the step of determining, based on the information acquired by the above-described acquiring means, whether the respective imparting amounts of the plurality of different kinds of inks exceed respective predetermined amounts that have been predetermined corresponding to the respective inks. In this determining step, (a) when it is determined that the respective imparting amounts of all of the plurality of different kinds of inks exceed the respective predetermined amounts, printing with respect to the predetermined region is performed in the unidirectional print mode; and (b) when it is determined that the determining means determines that at least one of the respective imparting amounts of the plurality of different kinds of inks does not exceed the predetermined amount thereof, printing with respect to the predetermined region is performed in the bidirectional print mode.

Furthermore, the present invention provides a control program for controlling an ink jet print apparatus that performs printing on a print medium using print heads for discharging a plurality of different kinds of inks. This program comprises the step of acquiring, based on print data corresponding to the predetermined region on the print medium, information of respective ink amounts to be imparted to the predetermined region for the plurality of different kinds of inks; the step of determining, based on the above-described information acquired by the acquiring means, whether the respective imparting amounts of the plurality of different kinds of inks exceed respective predetermined amounts that have been predetermined corresponding to the respective inks. In the determining step, (a) when it is determined that the respective imparting amounts of all of the plurality of different kinds of inks exceed the respective predetermined amounts, a unidirectional print mode where printing is performed by any one of a main scan in an advance direction and that in a return direction of the print heads, is selected, and (b) when it is determined that at least one of the respective imparting amounts of the plurality of different kinds of inks does not exceed the predetermined amount thereof, a bidirectional print mode where printing is performed by both the main scan in the advance direction and that in the return direction of the print heads, is selected.

Moreover, the present invention provides a computer-readable storage medium that stores the above-described control program.

Also, the present invention provides an ink jet printing method where printing is performed in any one of a bidirectional printing mode where printing is performed on a print medium by both a main scan in an advance direction and that in a return direction of print heads for discharging a plurality of different kinds of inks, and a bidirectional printing mode where printing is performed on the print medium by one of the main scan in the advance direction and that in the return direction of the print heads. This method comprises the step of acquiring, based on print data corresponding to the predetermined region on the print medium, information of the respective ink amounts to be imparted to a predetermined region for the plurality of different kinds of inks; and the step of determining, based on the information acquired by the acquiring means, whether the respective imparting amounts of the plurality of different kinds of inks exceed respective predetermined amounts that have been predetermined corresponding to the respective inks; and the step of switching a print mode to be used from the bidirectional print mode to the unidirectional one when, in the determining step, it is determined that the respective imparting amounts of the plurality of different kinds of inks exceed the respective predetermined amounts.

With these arrangements, for predetermined regions where different kinds of inks are discharged, when the respective imparting amounts of the plurality of different kinds of inks exceed the respective predetermined amounts, printing with respect to the predetermined region is performed in the unidirectional print mode (print by one of the advance scanning and the return scanning) instead of performing in the bidirectional print mode (print by both the advance scanning and the return scanning). Thereby, with regard to the above-described different kinds of inks, printing by using ink imparting amounts exceeding the above-described predetermined amount can be prevented from being performed by the bidirectional scanning. This allows uneven colors (uneven densities) caused by discharge time difference, which would occur in a bidirectional printing, to be eliminated.

Further objects, features and advantages of the present invention will become apparent from the following description of the preferred embodiments with reference to the attached drawings.

DESCRIPTION OF THE PREFERRED EMBODIMENTS

In the embodiments according to the present invention, when attempting to perform a bidirectional printing using a recording head having a configuration where columns of nozzles that discharge black ink with a low permeability along, for example, a subsidiary scanning direction, and columns of nozzles that discharge color inks with a permeability different from that of black ink, i.e., super-permeability, are arranged in a longitudinal arrangement, printing is performed by dividing print data for each band into a plurality of regions, acquiring respective imparting amounts of a black ink and color inks for each region, determining whether the respective imparting amounts exceed respective predetermined values, and if so, switching printing from bidirectional printing to a unidirectional one.

With these arrangements, when uneven color due to a time difference is liable to occur, the uneven color can be reduced by unidirectional printing. Meanwhile, when the uneven color does not so occur, for example, when a text including color letters is to be printed, a reduction in the recording speed can be minimized since bidirectional printing is performed. Thus, the present invention is capable of suppressing a reduction in the recording speed to a necessary minimum while inhibiting an occurrence of uneven color caused by a time difference between black and colors.

Hereinafter, embodiments according to the present invention will be described with reference to the accompanying drawings.

First Embodiment

Description of the Apparatus

Figure 1:
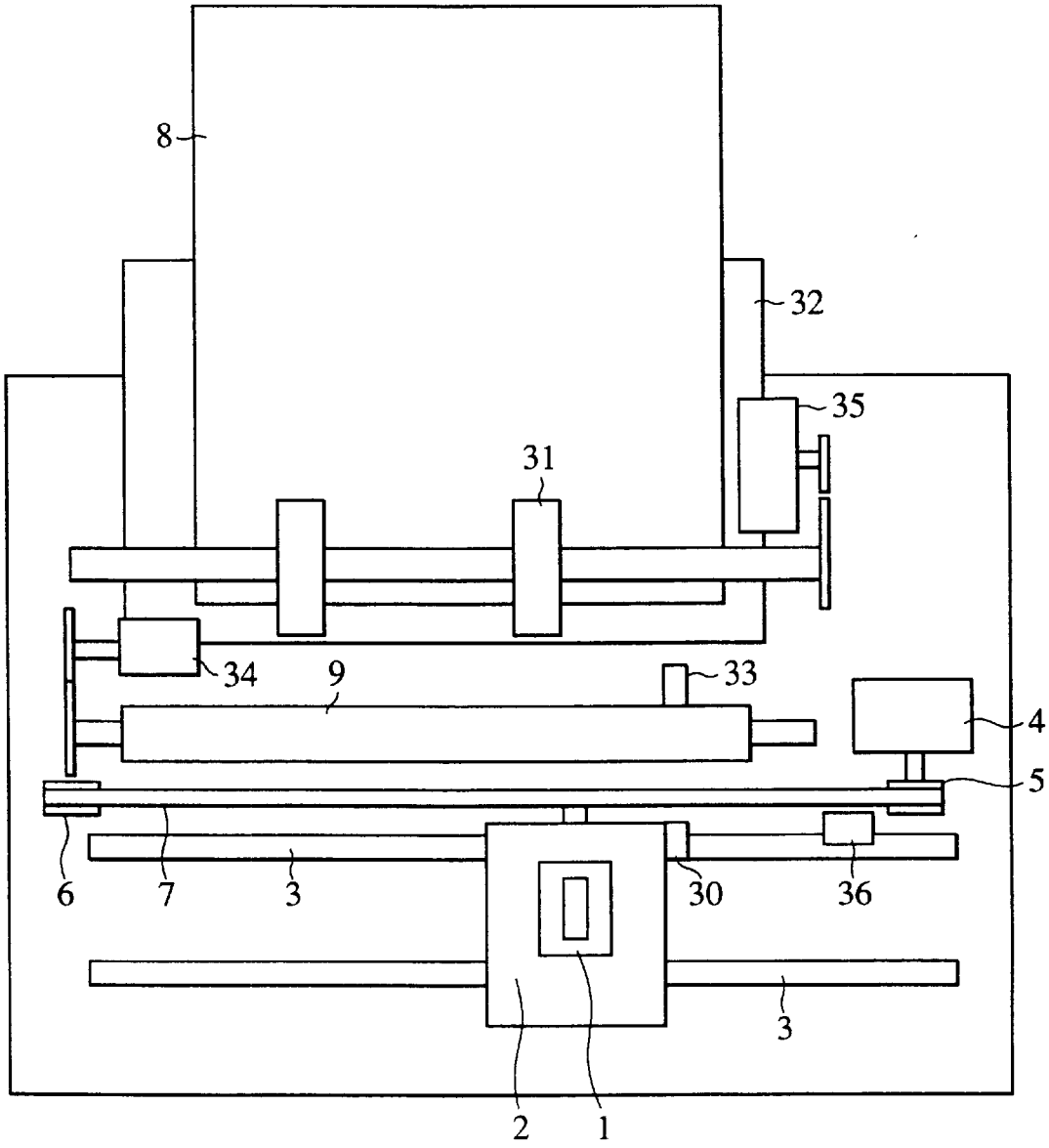
FIG. 1 is a schematic perspective view showing the configuration of the main section of an ink jet printer according to a first embodiment of the present invention.

FIG. 1 is a schematic perspective view showing the configuration of the main section of an ink jet printer according to a first embodiment of the present invention.

Referring to FIG. 1, a head cartridge 1 is detachably mounted on a carriage 2, so that a used head cartridge can be replaced with a new one. The head cartridge 1 includes a print head and an ink tank, which stores ink to be supplied to the print head, with both the print head and the ink tank being integrally formed, and the print head and tank are arranged to be detachable from each other. The print head of the head cartridge 1 also has a connector (not shown) for transmitting/receiving, e.g., a signal for driving the print head to discharge ink between it and the printer body.

As will be described later, the print head of the head cartridge 1 has a configuration where a plurality of ink discharge ports (nozzles) of black ink (K) and color inks of cyan (C), magenta (M), and yellow (Y) are arranged. The print head has, for each nozzle thereof, a discharge heater constituted of an electrothermal converter, and is arranged to generate bubbles in the inks by utilizing thermal energy generated by the heater due to the driving of the head, thereby discharging the inks under the pressure of the bubbles. Here, the method for discharging ink is not limited to such a method using thermal energy. For example, other methods, such as a method where ink is discharged by an electromechanical element such as a piezoelectric element may instead be used. Also, the application of the present invention is not restricted to an ink jet type print apparatus. The present invention can be applied to a print apparatus of any type that makes a difference in the hue by a time difference in printing.

The head cartridge 1 is positioned with respect to the carriage 2, and corresponding to this, the carriage 2 has a connector holder (electric connection portion) for transmitting a drive signal and the like to each of the heads. The carriage 2 is reciprocatably guide-supported along two guide shafts 3, which extend in the direction crossing the printer and which is fixed to the apparatus body. The movement of the carriage 2 along the guide shafts 3 is made possible by transmitting the driving force of a carriage motor 4 to the carriage 2 via drive mechanisms such as a motor pulley 5, a follower pulley 6, and a timing belt 7. The control of the position and movement of the carriage 2 is performed by a controller described later in FIG. 2. This movement allows scanning for printing on a print medium 8. In addition, the carriage 2 has an optical home-position sensor 30, which can detect the position of the carriage 2 by the optical path of itself being blocked by a shield plate 36 when the carriage 2 arrives at the position of the shield plate 36 disposed at a predetermined position outside the scanning range.

The print media 8 such as print paper or plastic thin-plates are separated and fed one after one by an autofeeder (hereinafter referred to as ASF) 32, by transmitting the driving force of a paper feed motor 35 to a pick-up roller 31 via a gear train and thereby rotating the pick-up roller 31. Each of the print media 8 is then conveyed through the position (print portion) opposite to the surface of the discharge port of the head cartridge 1 by a conveying roller 9 rotated by the driving force of the LF motor 34, and a pinch roller paired therewith. At that time, the determination as to whether the print medium 8 has been fed up to a predetermined position and the detection of a start position, is performed by using a paper end sensor 33. The paper sensor 33 is also used when detecting where the rear end of the print medium 8 is, and when ultimately detecting the print position at that time from the actual rear end. For the conveyance of the print medium, a paper discharge roller similar to the conveying roller and a spur are provided in the downstream of the print portion, so that paper discharging associated with the above-described conveying of the print medium 8 can be performed.

The print medium 8 is arranged so that the bottom surface thereof is supported on a platen (not shown) so as to form a flat print surface in the print portion. The head cartridge 1 mounted on the carriage 2 is held so as to be parallel to the print medium 8 between the conveying roller and the paper discharge roller by projecting the surface of the discharge port of the print head thereof downward from the frame of the carriage 2.

Figure 2:
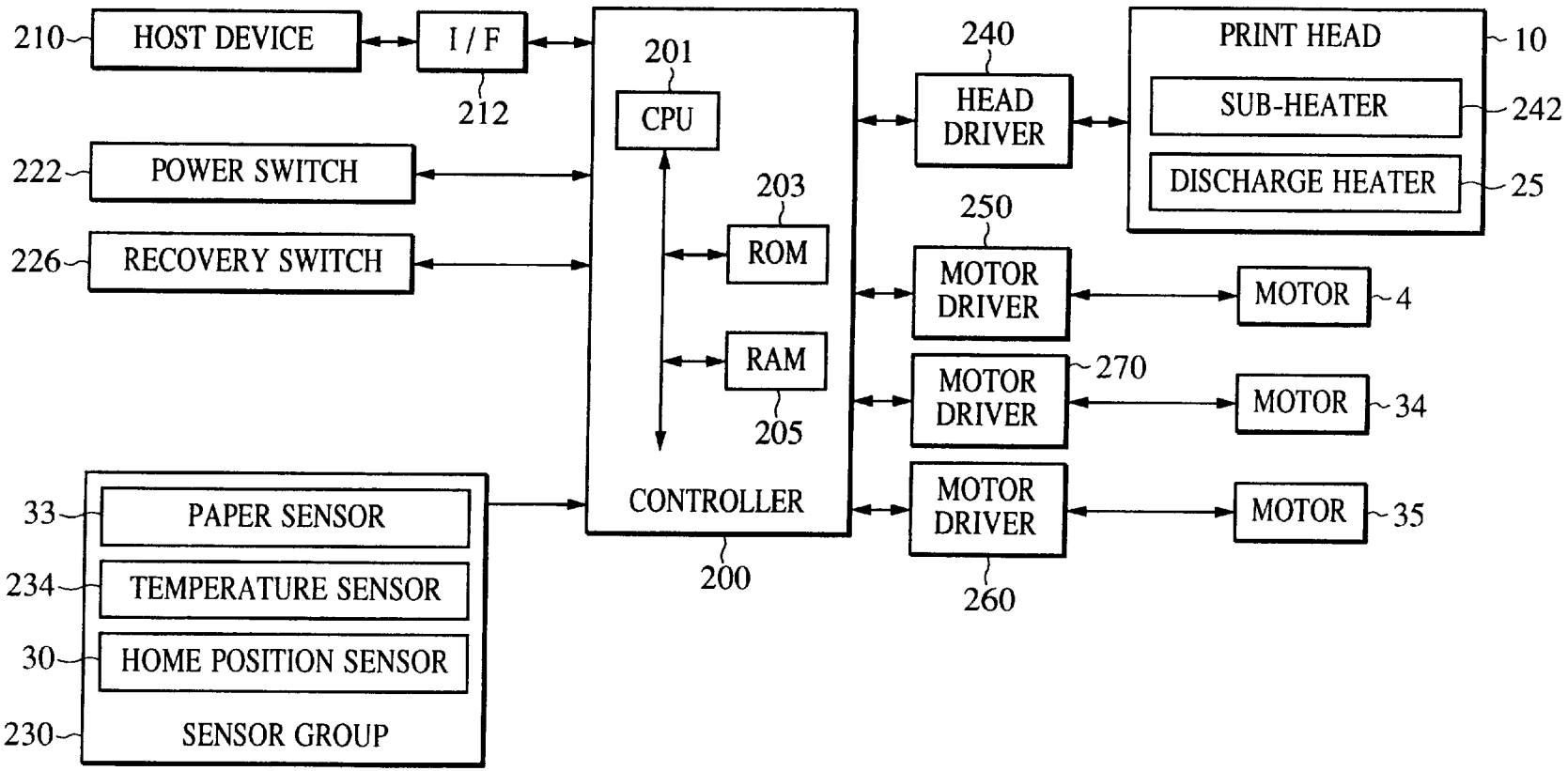
FIG. 2 is a schematic block diagram showing the configuration of the control circuit of the ink jet printer in FIG. 1.

FIG. 2 is a schematic block diagram showing the configuration of the control circuit of the above-described ink jet printer.

Referring to FIG. 2, a controller 200 is a main control portion, and for example, comprises a microcomputer type CPU 201; ROM 203 storing the program, required tables, and other fixed data; and RAM 205 having regions where image data are developed, and operation regions and the like. The controller 200 executes processing in the printer in this embodiment, such as processing described later in FIGS. 7, 8, and 10, and the control of action. A host device 210 supplies image data to be printed to the printer. This host device 210, therefore, can be used as a computer that performs the production of data such as letters and images to be printed, and that performs processing to cause the printer to print these data. Alternatively, the host device 210 can also be used as a device that at least can supply image data to the printer, for example, as a reader that reads images. The controller 200 transmits and receives image data, other commands, status signals, and the like between it and the host device 210 via an interface (I/F) 212.

As an operation portion, there is provided a switch group that receives instruction inputs by an operator. The operation portion includes a power switch 222, a recovery switch 226 for indicating the actuation of suction recovery, and the like. As a sensor group for detecting the state of the print apparatus, a censor group 230 is provided which comprises the above-mentioned home position sensor 30, a paper end censor 33 for detecting the presence/absence of a print medium, a thermal sensor 234 disposed at a suitable part in the printer for detecting the environmental temperature of the printer, and the like.

A head driver 240 drives the print head 10 based on the print data that is sent from the host device 210 as described above and to which a predetermined processing for discharge is performed by the controller 200. As a result, a predetermined voltage pulse is applied to the discharge heater 25 of the print head nozzle, which discharges ink, and the above-mentioned thermal energy occurs, thereby discharging ink. Specifically, the head driver 240 includes a shift register that aligns print data corresponding to the position of the discharge heater 25 of each nozzle, a latch circuit that latches these data in the shift register at a suitable timing, a logical circuit element that applies a voltage pulse to the discharge heater 25 in synchronization with a drive timing signal, a timing setting portion that suitably sets a drive timing (discharge timing) for performing an alignment of the position where a dot is to be formed by ink discharge, and the like.

The print head 10 has a sub-heater 242. The sub-heater 242 is used to perform a temperature adjustment for maintaining the discharge characteristic of ink constant, and is formed on a substrate simultaneously with the discharge heater 25. Beside this configuration, the sub-heater may have another configuration, such as a configuration such as to be affixed to the print head body or the head cartridge.

As a driver for driving the carriage motor 4, a motor driver 250 is provided, and as a driver for driving the LF motor 34, a motor driver 270 is provided. Also, a motor driver 260 is used as a driver for driving the paper feed motor 35.

Figure 3:
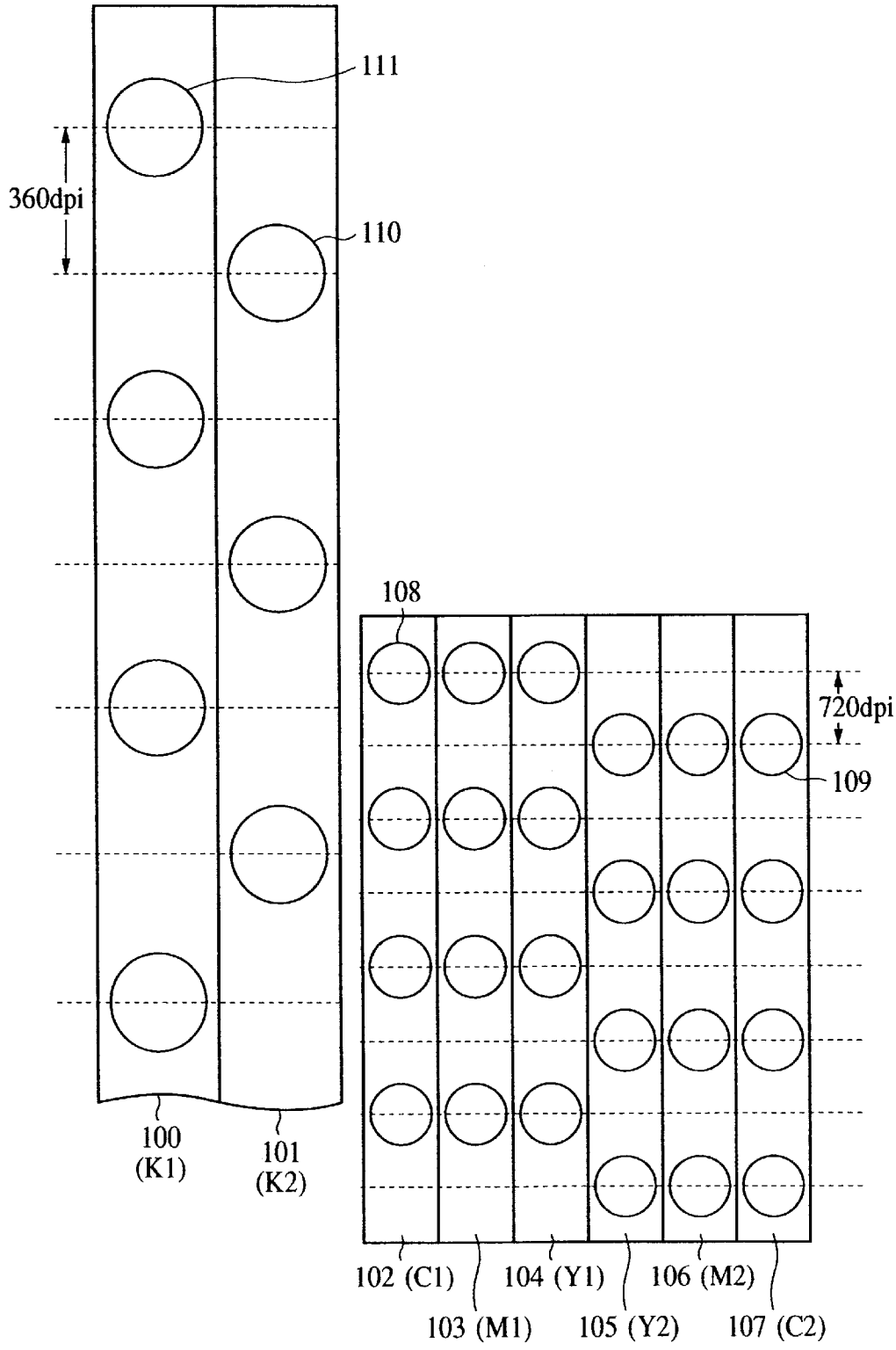
FIG. 3 is a schematic view illustrating, for each ink, the surface of a discharge port in the print head of the head cartridge used for the printer shown in FIG. 1.

FIG. 3 is a schematic view showing, for each ink, the surface of a discharge port in the print head 10 of the head cartridge 1, where one portion of the head of a black ink is omitted from illustration, and where the nozzles are depicted as having a fewer number of nozzles than the real cases in order to simplify illustration.

Referring to FIG. 3, referential numerals 100 and 101 denote K nozzle columns K1 and K2 that discharge a black ink, respectively. Reference numeral 102 denotes a first C nozzle column C1 that discharges cyan ink as a color ink, numeral 103 denotes a first M nozzle column M1 that discharges magenta color ink, and numeral 104 denotes a first Y nozzle column Y1 that discharges yellow color ink. Likewise, reference numeral 105 designates a second Y nozzle column Y2 that discharges yellow as a color ink, numeral 106 designates a second M nozzle column M2 that discharges magenta color ink, and reference numeral 107 designates a second C nozzle column C2 that discharges cyan ink color.

The print head 10 comprises this nozzle column group. Each of the nozzle columns in the print head 10 has a plurality of ink discharge ports (nozzles), as shown in FIG. 3. Two nozzle columns provided for a black ink and color inks are arranged so that the nozzle arrangement thereof are mutually deviated in the vertical direction in the figure by a half pitch. Thereby, dot forming by black and colors can be performed at a density twice as high as the print density by the nozzle arrangement pitch of each of the nozzle columns. For example, the first C nozzle column 102 C1 and the second C nozzle column 107 C2, which discharge cyan ink, can perform printing at a density of 720 dpi, which is twice as high as the nozzle arrangement density 360 dpi of each of the nozzle columns, by the respective nozzles 108 and 109. The same goes for the nozzle columns of black ink. The arrangement density 180 dpi of each of the nozzles 110 and 111 in the nozzle columns of black ink becomes 360 dpi by the two nozzle columns thereof, and allows printing at this density to be performed. Here, the arrangement density of black ink is half that of each color ink. This is because the discharge amount from each of the nozzles of the black ink is higher than that from each of the color inks, and thereby the size of the black ink dot becomes twice as large as that of each of the color inks. Such a nozzle arrangement allows printing at an appropriate density to be performed even though dots of color inks and a dot of a black ink are intermingled.

As shown in FIG. 3, individual nozzle columns are configured so that, when the nozzle columns are mounted on the carriage, the individual nozzle columns are arranged in a direction substantially perpendicular to the scanning direction thereof. Since each of the nozzle columns is driven in a time division mode, discharge timing can be varied among the nozzle columns even if the nozzle columns are ones of the same ink. As a consequence, the arrangement direction of the overall nozzle columns of the black ink and color inks slightly deviates from the above-described direction perpendicular to the scanning direction. These nozzle columns for each of the black ink and color inks are arranged so as to be arranged along the scanning direction when mounted on the carriage. Specifically, as shown in FIG. 3, the nozzle columns for each of the black ink and color inks are arranged along the scanning direction in the order as follows: the K nozzle columns 100 (K1) and 101 (K2) for black ink, the first C nozzle column 102 (C1) for the cyan ink, the first M nozzle column 103 (M1) for the magenta ink, the first Y nozzle column 104 (Y1) for a yellow ink, further, the second Y nozzle column 105 (Y2) for the yellow ink, the second M nozzle column 106 (M2) for the magenta ink, and the second C nozzle column 107 (C2) for the cyan ink.

In the print heads in the present embodiment, the K nozzle columns 100 (K1) and 101 (K2) discharging the black ink are made longer than the color nozzle columns (C1, C2, M1, M2, Y1, and Y2) discharging the cyan, magenta, and yellow inks, respectively. Thereby, in the region where monochrome images and the like are printed, only the K nozzle columns 100 (K1) and 101 (K2) are used, and printing is performed by using the nozzles over the entire range, thereby allowing a speed-up of printing to be realized.

On the other hand, in the region where a black ink dot and a color ink dot are intermingled, printing is performed by limiting the nozzle usable range of the nozzle columns 100 (K1) and 101 (K2). Specifically, as will be shown later in FIG. 4, the arrangement relation between the nozzle columns for black ink and those for color inks is adapted to become the positional relation where they are mutually displaced along the direction perpendicular to the scanning direction, namely, the relation of the above-described longitudinal nozzle-arrangement. Thereby, an imparting time difference between the black ink and the color inks that are to be imparted to the above-described region where the black ink dot and the color ink dots are intermingled, can be sufficiently secured. In particular, as in the present embodiment, when there is a large difference in the permeability between the black ink and the color inks (cyan, magenta, and yellow ink), it is possible to reduce degradation in the image quality caused by bleeding or white haze, which can occur when these inks are discharged at the identical scanning.

Figure 4:
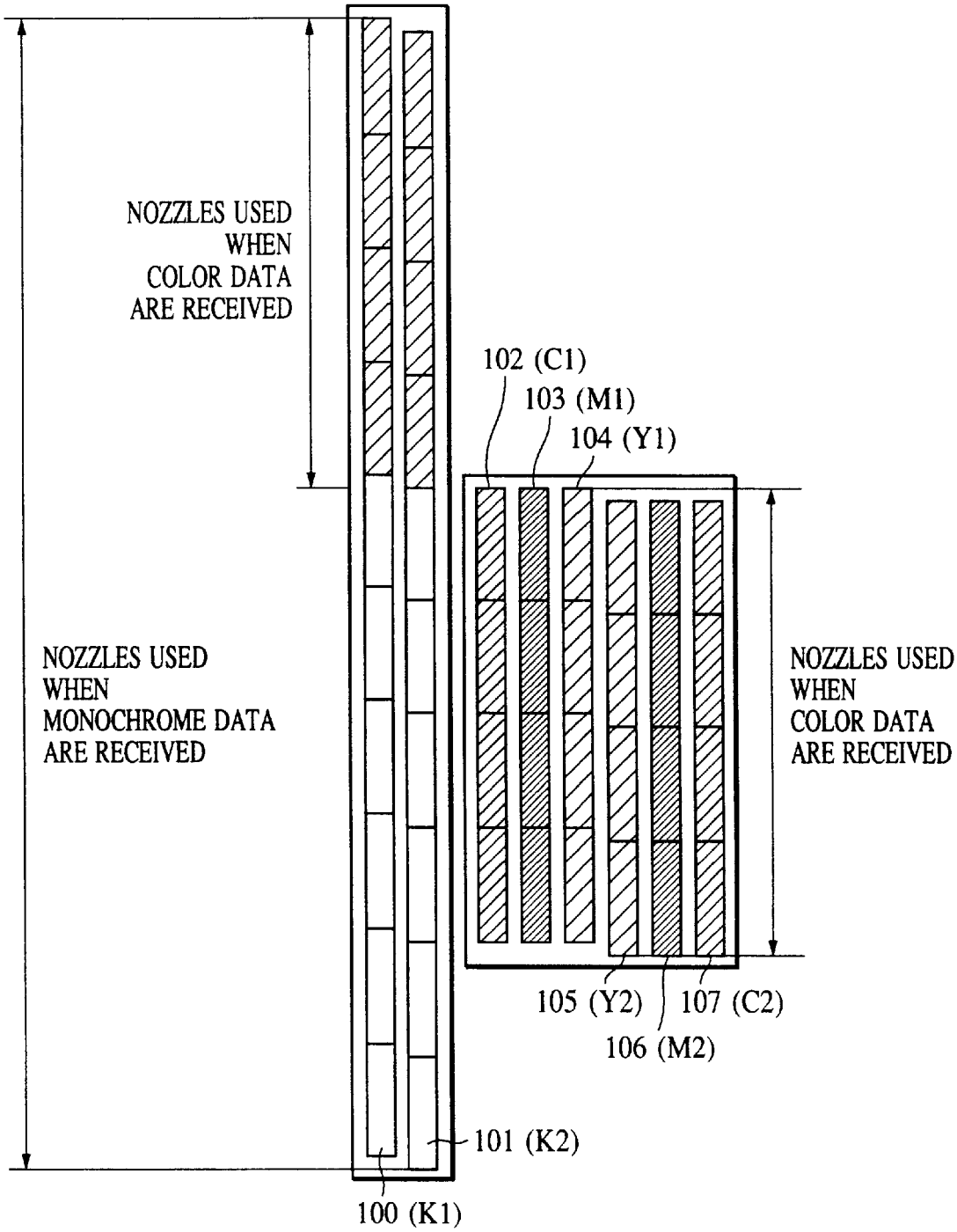
FIG. 4 is a detailed diagram illustrating particularly the arrangement relation between columns of nozzles for black ink and columns of color inks in the print heads shown in FIG. 3.

FIG. 4 is a detailed diagram illustrating particularly the arrangement relation between columns of nozzles for black ink and columns of nozzles for color inks in the print heads shown in FIG. 3.

As described with reference to FIG. 3, when printing is performed in the color mode, all nozzles of the nozzle columns for black ink 100 (K1) and 101 (K2) are not used, but one portion of all nozzles, that is, the nozzles denoted as "nozzles used when color data are received" in FIG. 4, are employed. On the other hand, when printing monochrome images or the like, all nozzles of the nozzle columns for black ink 100 (K1) and 101 (K2) are employed. Meanwhile, with regard to all nozzle columns for the color inks, the nozzles denoted as "nozzles used when color data are received" in FIG. 4, that is, all nozzles for color inks are employed. These nozzles to be used are configured to be arranged in the range within which 128 dots equivalent to an arrangement density of 360 dpi can be formed, in either of cases of black ink and color ink. Specifically, as described above, from the respective arrangement densities of the nozzle columns of black and colors, 128 nozzles are used in total in the nozzle columns 100 (K1) and 101 (K2) for black ink, while in the nozzle columns for each of the color inks, 256 nozzles (in total) of the two print heads are used.

In the above-described usable range, an offset equivalent to 128 dots is provided between the group of two nozzle columns for black ink and the group of two nozzle columns for color inks, and thereby, during scanning of the print heads, the nozzle columns for black ink and those for color inks performs a main scan with respect to mutually different regions with the same size. Here, paper feed equivalent to a length of 128 dots is performed between a main scan and the next main scan, and thereby, with regard to printing with respect to a scanning region with a width of 128 dot, a time difference equivalent to one scan is fundamentally provided between the discharge of the black ink and that of each of the color inks.

In the above-described print head configuration and printing method, black ink dots and color ink dots are intermingled. For example, for printing an image and the like of color such as gray, when bidirectional printing (printing by both a main scan in the advance direction and that in the return direction) is performed, differences in the density, i.e., uneven colors can occur particularly at both ends of a band in the main scanning direction for each band with a width of 128 dots, as described above.

Figures 5A, 5B:
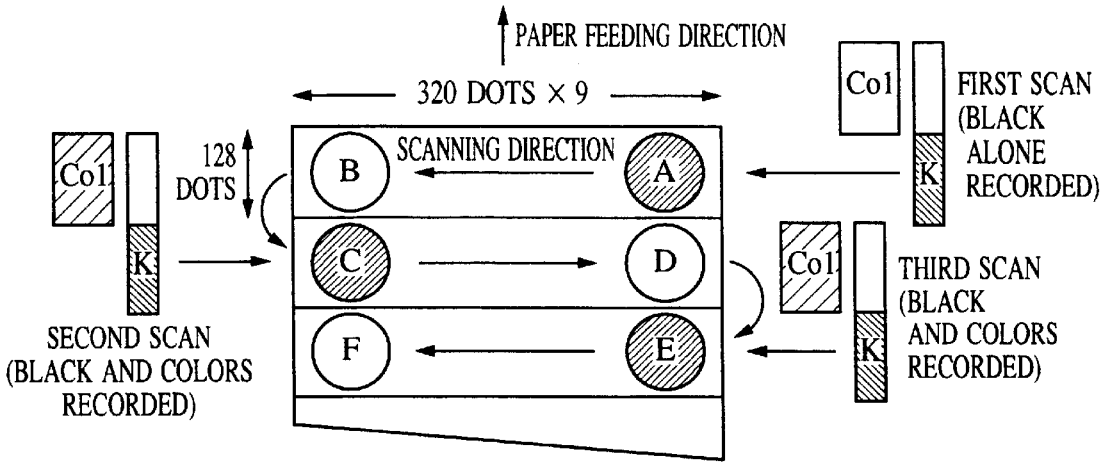
FIGS. 5A and 5B are diagrams showing an occurrence of the difference in the density, i.e., uneven color when printing in color mode is performed by bidirectional scanning.

FIGS. 5A and 5B are diagrams showing an occurrence of difference in the density when printing in color mode is performed by bidirectional printing. Herein, in FIG. 5A, the positional relation between the nozzle columns for black ink and those for color inks is looked at as if to be opposed to the positional relation therebetween shown in FIGS. 3 and 4. However, when this positional relation in FIG. 5A is viewed with respect to the paper feeding direction, it is evident that the positional relation in FIG. 5 is the same as that in FIGS. 3 and 4.

Referring to FIG. 5A, at a first main scan (first advance scan), only nozzle columns for black ink correspond to the uppermost band (first region) with a width of 128 dots, so that only black ink is discharged. Next, after the above-described first main scan, a paper feed equivalent to a width of 128 dots (one band width) is performed, and then a second scanning, which is a scanning in the return direction. In this second main scan (second return scan), nozzle columns for color inks correspond to the uppermost band (first region) from which the black ink has been discharged, so that color inks are discharged. Furthermore, nozzle columns for black ink corresponds to the next band (second region), so that only black ink is discharged. In this case, an end region B in the uppermost band (first region) is a region where each of the inks is discharged either before or after the scanning direction of the print heads is changed over. On the other hand, an end region A is a region where each of the inks is discharged with a time difference equivalent to one round trip.

When repeating such a bidirectional printing, the time when the black ink and the color inks are imparted, becomes significantly different therebetween particularly at the ends of each of the bands. In FIG. 5A, end regions A, C, and E of each of the bands is the region where the imparting time difference between the black ink and color inks becomes the maximum, while end regions B, D, and F is the region where the above-mentioned time difference becomes the minimum. With regard to regions other than these end regions, the black ink and color inks are imparted with a time difference according to the position. In this case, in the regions A, C, and E where the imparting time difference between the black ink and color inks is large, as shown in FIG. 5B, when the black ink becomes fixed to a certain extent, color inks are imparted, so that a high-density gray is printed. Conversely, in the regions B, D, and F where the imparting time difference between the black ink and color inks is small, as shown in FIG. 5B, when the earlier discharged black ink has not yet fixed, super-permeable color inks are imparted thereon, so that the black ink gets into paper together with the super-permeable color inks, thereby printing a low-density gray. In this manner, according to the discharge time difference between the black ink and color inks, density differences, such as "thick" and "thin", are alternately repeated in band width units, particularly at the end portions of a band.

Figure 6:
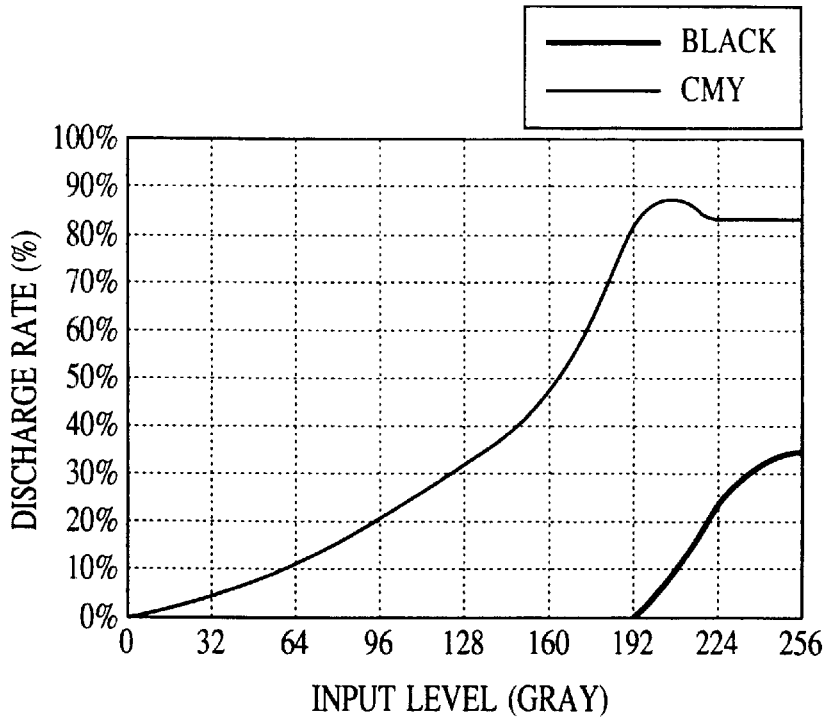
FIG. 6 is a graph illustrating respective discharge rates (duties) of a black ink dot and color ink dots when printing is performed based on the input level, which is the gradation value of gray as image data, in the ink jet printer according to the first embodiment.

FIG. 6 is a graph illustrating the respective discharge rates (duties) of a black ink dot and color ink dots when printing is performed based on the input level, which is the gradation value of gray as image data, in the ink jet printer according to the first embodiment.

Referring to FIG. 6, in the gradation value region up to an input level of 192/255, gray is expressed only by process black, that is, a mixture of C, M, and Y ink dots. Thereby, it is possible to suppress granularity of a print image caused by the dot of the black ink, which is a high-density pigment, being present at a relatively low-density region. Also, since the gray is printed only by super-permeable color inks, uniform image can be obtained. On the other hand, in the gradation value over an input level of 192/255, since a low-permeable black ink is imparted in addition to color inks, uneven density due to discharge time difference becomes prone to occur, as described above.

Accordingly, in the present embodiment, for each of scanning region (one band) with a width equivalent to 128 dots in an image to be printed, discharge amounts of black ink and color inks are determined, and when a discharge amount is such that the above-mentioned uneven density due to a time difference is conspicuous, printing is performed by switching from a bidirectional printing to a unidirectional one, thereby substantially equalizing the discharge time difference between black and colors particularly at both ends in a band. The details thereof will be described below.

Dot Count Processing

Figure 7:
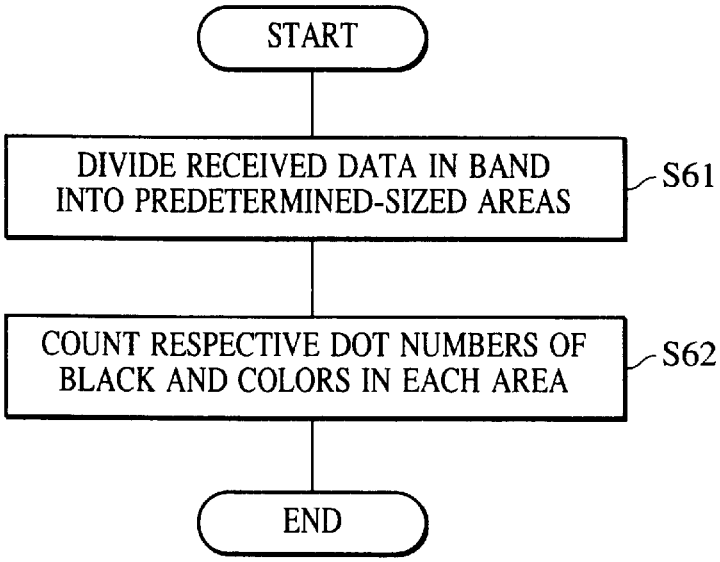
FIG. 7 is a flowchart showing the processing for the management of the ink discharge amount in one band having a width equivalent to 128 dots, which is shown in FIG. 5A.

FIG. 7 is a flowchart showing the processing for the management of the scanning region with a width equivalent to 128 dots which is shown in FIG. 5A, that is, the ink discharge amount in one band.

First, at step S61, data equivalent to the above-mentioned band of the image data received from a host device are divided into predetermined sized areas. In the present embodiment, this area size is set to be 128 dots (pixels)×320 dots (pixels). As shown in FIG. 5A, this area is formed in a manner such that, for a band, division is performed in the main scanning direction without performing division in the widthwise direction. Specifically, in A size, a size divided into nine equal parts is equivalent to 320 dots. Of course, the size to be divided is not limited to this example. As will be described later, the determination criterion as to whether printing is to be changed over to unidirectional printing, is different depending on the specification and the like of the apparatus, and therefore, the area size for the determination can also be determined depending on the specification and the like of the apparatus.

Next, at step S62, with respect to each areas divided as described above, i.e., each "divided areas", the number of dots to be formed (dotted) with respect to each of the divided areas is counted separately for black ink and color inks. Hereinafter, processing is performed based on the dot information for each of these counted areas.

Area Number Determination

The information thus obtained is studied on each areas (each divided area), and the number of areas exceeding a predetermined dot number described later, for all of black ink and color inks. If the number of areas exceeding the predetermined dot number exceeds a predetermined value, unidirectional printing is performed, and if it is not more than the predetermined value, bidirectional printing is performed.

The threshold value in this determination is set at 1, since the area size is set to be relatively large in this embodiment. In other words, if only there is one area of which the dot number exceeds a predetermined dot number of any of black ink and color inks, printing is performed by unidirectional printing. Here, the threshold value of the area number is related to the size of each of the areas into which print data are divided for each band. As this threshold number, for example, an area number such that the above-described uneven density due to time difference begins to be visually noticeable, may be selected. This means to use a value peculiar to the print apparatus as a threshold number, since the threshold number is related to the size of each of the areas into which print data are divided for each bands, as described above.

In addition, the threshold value of a dot number for each area is determined as follows. From the discharge rate in each gradation value of gray print shown in FIG. 6, it can be seen that uneven density due to the above-mentioned discharge time difference occurs in the region where the discharge rate is higher than 10% for black ink, and is higher than about 80% for color inks. The threshold value of dot number for each area, therefore, is 128×320×10%=4096 dots for black ink dot, and is 128×320×2×80%=65536 dots for color ink dot. The reason why the color ink dot is subjected to double processing (×2) is because the nozzle arrangement density of a color ink head is twice as high as that of black ink head, and thereby one dot of the above-described dot count of color ink is equivalent to two drops of black ink discharged. The above-mentioned processing, therefore, is one that is performed in order to compare this to the threshold value. That is, such processing is performed so that a dot count for each area is performed with respect to the discharge data of each of the inks.

As described above, the discharge time difference varies depending on the position in a band. That is, as evident from the fact that the discharge time difference is the maximum at one end of the band while it is the minimum at the other end thereof, the discharge time difference varies depending on the position in a band. In this embodiment, however, with regard to the division of area in order to determine the dot number, or the threshold value of the above-mentioned dot number, consideration as to at which position the area of interest is located is not given. The object of this is to make simpler the processing of the above-described determination and the control based on this.

Figure 8A:
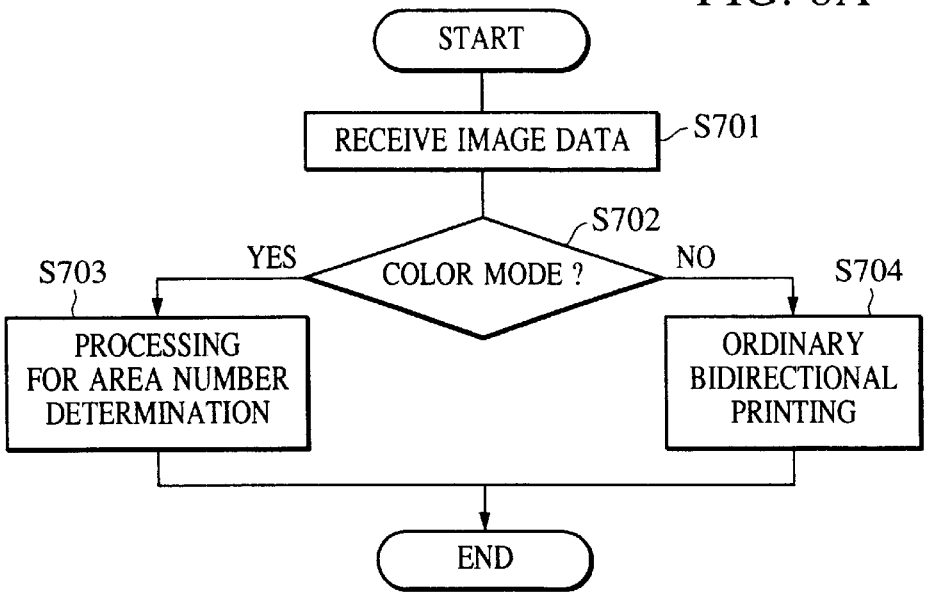
FIGS. 8A and 8B are flowcharts showing the processing for the area number determination according to the first embodiment of the present invention.
Figure 8B:
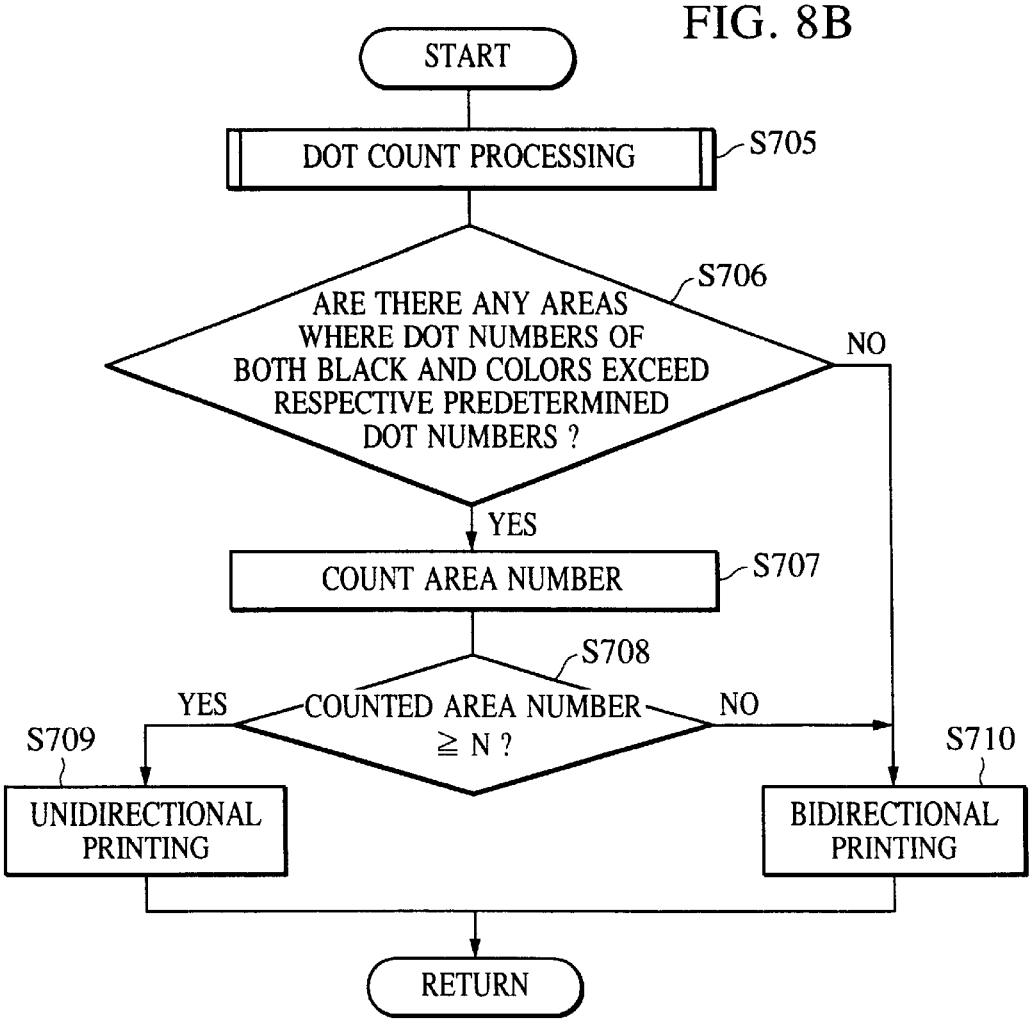

FIGS. 8A and 8B are flowcharts showing the processing for the above-described area number determination.

FIG. 8A shows a flowchart for determining whether area number determination should be performed. In this processing, if received image data are monochrome data (S702), since there is no possibility that uneven color occurs, ordinary bidirectional printing is performed (S704). On the other hand, if the mode is determined to be color mode (S702), area number processing is performed (S703).

FIG. 8B shows a flowchart for area number determination. This processing is performed for each of the bands. As shown in FIG. 5A, in one scan by the print heads, printing is performed with respect to two bands. In this processing, one band (the band on which black ink has already been discharged) of the two bands has already been subjected to this processing, that is, subjected to determination as to whether the printing thereof should be performed by bidirectional printing or a unidirectional one. With regard the above-described band, when scanning for color ink printing is to be performed, scanning according to the above-described determination is performed.

In this processing, first at step S705, the dot count processing shown in FIG. 7 is performed, and next at step S706, it is determined whether there are any areas where both black and colors exceed respective predetermined dot numbers as threshold values. If it is determined that there are no such areas, bidirectional printing is performed at step S710, and the processing proceeds to the next band processing.

At step S706, if it is determined that there are areas exceeding respective predetermined dot numbers, the area number is counted at step S707, and it is determined whether the area number exceeds a predetermined number (S708). If so, unidirectional printing is performed at step S709, and if the area number is not more than the predetermined number, bidirectional printing is performed at step S710.

As described above, in this embodiment, the threshold value of each area number as a determination criterion of step S708 is 1, and therefore, if there are any areas satisfying the condition in determination at step S706, the area number count processing at step S707 and S708 may be omitted, and the processing may proceed to bidirectional printing setting at step S710.

According to this embodiment, as described above, by selectively using the bidirectional printing mode, where printing is performed on a print medium by both the main scan in the advance direction and that in the return direction of the print heads, and unidirectional printing mode, where printing is performed on a print medium by either the main scan in the advance direction or that in the return direction of the print heads, it is possible to suppress uneven density caused by the imparting time difference between the black and color inks with a minimum of reduction in recording speed.

Second Embodiment

In the above-described first embodiment, when the number of areas where the respective dot numbers of black and colors exceed the predetermined number, uneven density due to the discharge time difference between black ink and color inks is suppressed by unidirectional printing. Notwithstanding, the unidirectional printing itself is doubtless a factor that reduces the printing speed over bidirectional printing.

In this embodiment, in a printer that performs scanning control that limits the scanning range of the print heads, according to image data, to a range smaller than the overall paper width, namely, to the range where an image to be printed is present, the time difference from the time when a black ink is earlier discharged in a predetermined area to the time when color inks are discharged there, is obtained. In addition, as in the case of the first embodiment, it is determined whether there are any areas where the respective dot numbers of both black and colors with respect to a predetermined area exceeds respective predetermined dot numbers, and when, by the above-mentioned determination, it has been determined that there is any area exceeding the predetermined dot number, and the above-mentioned obtained time difference exceeds a predetermined time, control is performed by switching printing from bidirectional printing to a unidirectional one.

Figure 9A:
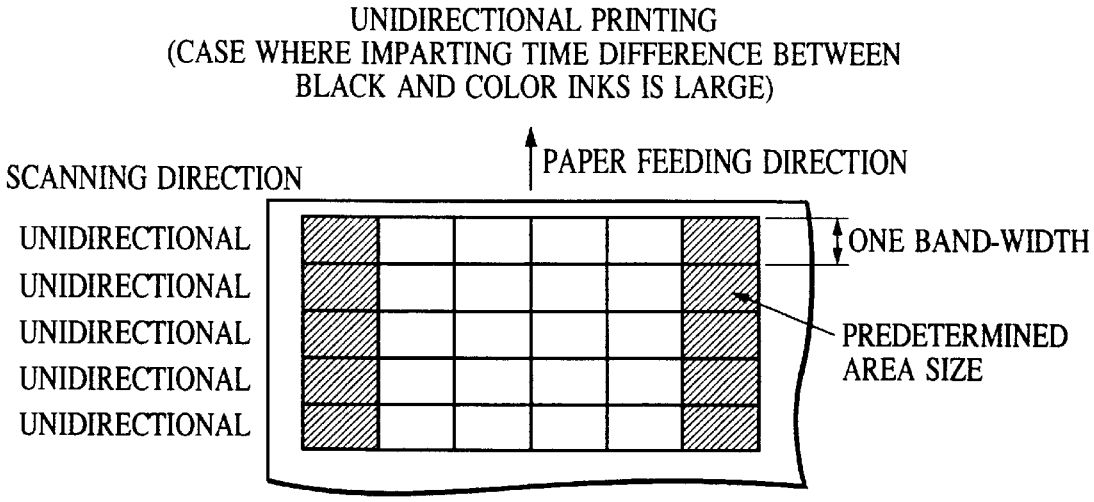
FIGS. 9A and 9B are schematic diagrams showing printing results when printing has been performed on print paper by varying the discharge time difference between black and color inks.
Figure 9B:
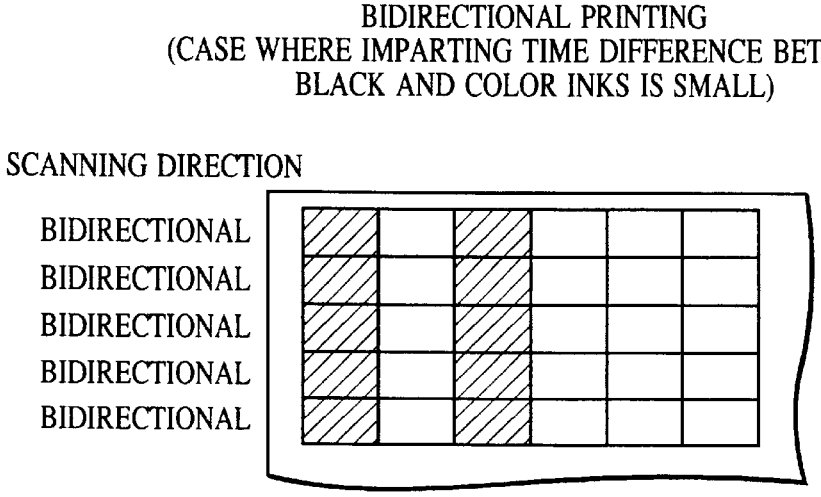

FIGS. 9A and 9B are schematic diagrams showing printing results when printing has been performed on print paper by varying the imparting time difference between black and color inks. Here, FIG. 9A shows the case where recording is performed with a discharge amount such as to produce uneven densities due to time differences at the right and left ends of each of the bands, and FIG. 9B shows the case where similar patterns are printed on the left end and a central portion at a distance of 2 inches therefrom.

In the example shown in FIG. 9A, when bidirectional printing is performed, since the above-described time difference becomes large at such a position, for example, a band-like uneven density occurs in the order of "thick—thin" from the front, when seen from the left end. On the other hand, in the example shown in FIG. 9B, even though bidirectional printing is performed, scanning is performed only between the left end and the central portion at a distance of 2 inches therefrom, so that a shorter scan width is required. As a result, the above-described time difference becomes relatively small, and thereby, although a band-like uneven density, strictly speaking, is present, it is not visually noticeable. In such a case, even if there are areas where dot numbers exceed the predetermined number, this embodiment does not conduct a changeover to unidirectional printing, but performs a control so as to continue unidirectional printing.

Figure 10A:
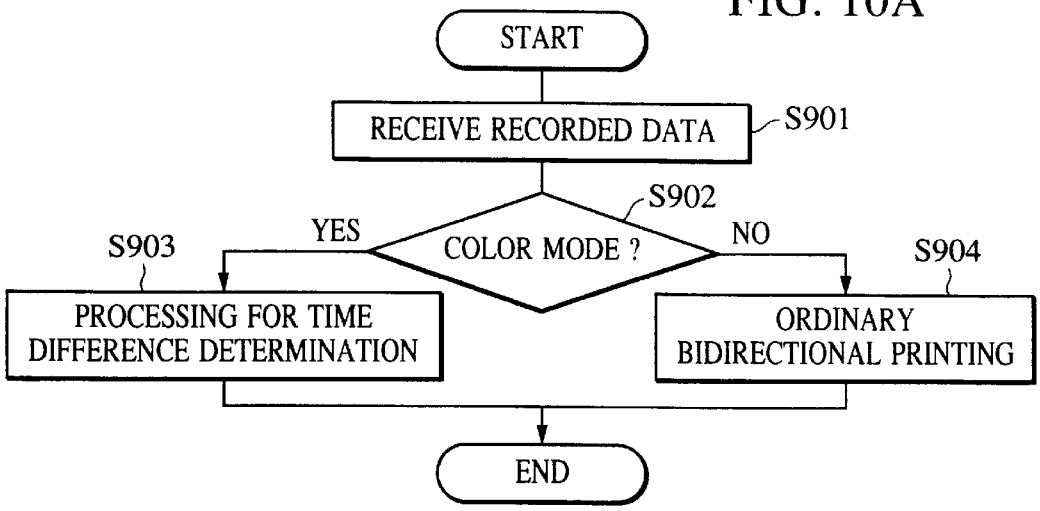
FIGS. 10A and 10B are flowcharts showing the processing for the time difference determination according to a second embodiment of the present invention.
Figure 10B:
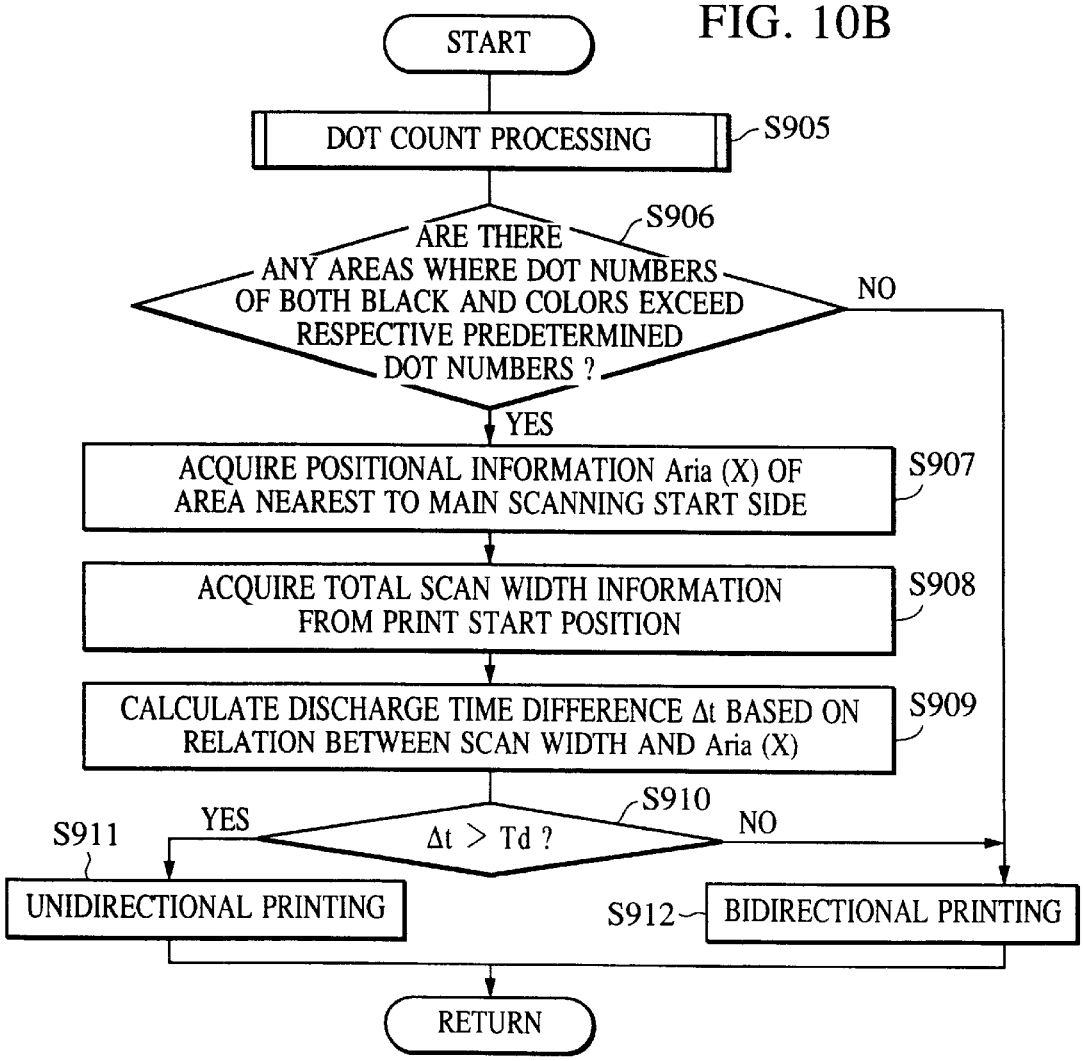

FIGS. 10A and 10B are flowcharts showing processing for the time difference determination according to the above-described second embodiment.

FIG. 10A shows a similar processing to that shown in FIG. 8A. At step S902, when it has been determined that image data are color data, the processing proceeds to step S903, the processing for time difference determination.

FIG. 10B shows this processing for time difference determination. As in the case of the processing shown in FIG. 8B, dot count processing is performed at step S905, and at step S906, it is determined whether there are any areas where dot numbers exceed the predetermined dot numbers. If so, at step S907, the area position information Aria (X) of the area nearest to the scanning start side of the print head among the areas where dot numbers exceed the predetermined dot numbers, is acquired. At the next step 908, the total scan width, which is the distance between the print start position and the farthest position therefrom with respect to the position of the image to be printed on the band, is acquired. At step S909, this total scan width, and the position information Aria(X) acquired at step S907 are calculated, and based on the scanning speed of print head, discharge time difference Δt described with reference to FIG. 9 is calculated. Then, at step S910, the time difference Td such as to permit a preset uneven density, and the above-described calculated time difference Δt are compared. If the calculated time difference Δt is smaller than Td, bidirectional printing is performed, while if the calculated time difference Δt is larger than Td, unidirectional printing is performed.

While in the first embodiment the processing shown in FIG. 8B is performed for each single band, in the present embodiment shown in FIG. 10B, the processing is performed at least for every two bands. This is because the scan width can vary depending on image data for each band, and when printing of two bands in total is performed by one scan for each black ink and color ink, scanning with respect to larger scan width is required. In this case, the processing of the above-described step S908 is performed with respect to the above-mentioned larger scan width.

According to the present embodiment, when the scanning range of the print heads is limited, according to image data, to a specified range smaller than the overall paper width, the maximum time difference of the preceding imparting for a black ink and that of the subsequent imparting for color inks is different from each other. Therefore, by determining this time difference and performing unidirectional printing only when the determined time difference exceeds a predetermined time difference, it is possible to reduce printing by unidirectional printing to the minimum, and to speed up printing while decreasing uneven density due to discharge time difference. Also, by identifying paper width size of recording data that is simply received and using this paper width size as information on the above-described scan width, changeover between bidirectional printing and a unidirectional one may be performed.

In the above-described two embodiments, descriptions have been made of the case where, with respect to each band, a black ink is earlier discharged, and thereafter color inks are discharged. In the present invention, however, the order of ink discharge is not limited to this order. With respect to each band, color ink may be earlier discharged, and thereafter a black ink may be discharged.

The present invention eliminates not only uneven density alternately occurring between bands, but also uneven density occurring in the range of a single band due to the above-described time difference. That is, uneven density in a single band where the density at one end of the single band is high and where the density at the other end is low as described above, can also be eliminated by changing over the printing to unidirectional printing. In this respect, beside so-called longitudinal arrangement heads shown in the above-described two embodiments, the application of the present invention can also reduce uneven density due to the time difference also occurring in the printing method where a print head configuration in which a black ink head and color ink heads are arranged along the scanning direction is used, and where, out of bidirectional scanning, for example, a black ink is discharged in the advance scanning and color inks are discharged in the return scanning (without paper feeding).

Third Embodiment

In the above-described first and second embodiments, one band width (one scan area width) corresponding to the used nozzle width of each of the nozzle columns is divided along a plurality of areas in the main scanning direction, and the above-described determination is performed for each area. Namely, the above-described determination is performed with respect to the entire area in one band. As described above, however, the area where uneven density due to discharge time difference between black and colors is prone to be conspicuous, is both ends in bands, and the central portion thereof is not so conspicuous.

Accordingly, in this third embodiment, the determination with respect to the entire area is not performed, but the determination is performed only for both ends thereof. Meanwhile, other arrangements are the same as those of the first and second embodiments. With these arrangements, since the above-described determination processing is performed only for both ends, the time required for the above-described determination can be shortened over the case where the entire area is determined.

Fourth Embodiment

In the first to third embodiments, a description has been made of the case where one band width (one scan width) corresponding to the used nozzle width of each of the nozzle columns is divided into a plurality of areas along the main scanning direction, and the dot numbers of the divided areas are determined. This fourth embodiment, however, is arranged so that one band width is not divided into a plurality of areas, but that the dot number determination is performed for the entire band.

According to this arrangement, when, although the printing duties of black and colors is high, amounts thereof imparted to the same position is small, that is, when the uneven density due to imparting time difference is not so conspicuous, unidirectional printing is performed. Therefore, although the recording time is prone to becoming long over the first to third embodiments, a reduction in the recording time can be achieved over the case where unidirectional printing is performed at all times. In addition, since the probability of performing unidirectional printing increases, the probability of reducing the above-described uneven density increases.

Fifth Embodiment

The degree of uneven density caused by the imparting time difference between black and colors varies depending on the kind of print medium. In other words, some media have a property where uneven density is relatively prone to be conspicuous, and other media have a property where uneven density is relatively prone to be inconspicuous.

Accordingly, in this fifth embodiment, a "predetermined" value used when determining whether the respective dot numbers of black and colors exceed respective predetermined values, that is, a "threshold number" that determines whether unidirectional printing should be used or bidirectional one should be used, are made varied depending on the kind of the print medium. That is, the value of "predetermined dot number" used in the determination processing in step S706 in FIG. 8B and step S906 in FIG. 10B is prepared corresponding to the kind of print medium. Specifically, a relatively low threshold value (first threshold value) is related to a medium (first print medium) having a property where uneven density is prone to be relatively conspicuous, while a relatively high threshold value (second threshold value) is related to a medium having a property where uneven density is prone to be relatively inconspicuous. When the first print medium is selected, dot determination processing is performed using the above-mentioned first threshold, while when the second print medium is selected, dot determination processing is performed using the above-mentioned second threshold.

According to this arrangement, the "threshold value" that determines whether printing should be performed by unidirectional printing or by a bidirectional one, is set to be the optimum value according to the kind of print medium, and therefore, in the case of a medium where uneven density is prone to be relatively inconspicuous, the probability of changing over to unidirectional printing is reduced, thereby suppressing the occurrence of uneven density while inhibiting a reduction in the recording speed.

Sixth Embodiment

The present invention is not restricted to a configuration where processing shown in FIGS. 7, 8, and 10 is performed on the side of the ink jet recording apparatus. Alternatively, a configuration where processing shown in FIGS. 7, 8, and 10 is performed on the side of a host computer connected to the ink jet recording apparatus, may be adopted. That is, the above-described dot number determination processing and time difference determination processing may be performed in the host computer in which a printer driver controlling the ink jet recording apparatus, is installed. The present invention encompasses this configuration.

Other Embodiments

Needless to say, the object of the present invention can also be achieved by supplying a system or equipment with a storage medium that has recorded soft ware program codes that implement the functions of the above-described embodiments, and by a computer (alternatively CPU or MPU) for the system or equipment reading and executing the program codes stored in the storage medium.

In this case, the program codes themselves read out from the storage medium realize the functions of the above-described embodiments, and the storage medium constitutes the present invention. Furthermore, the program itself also constitutes the present invention.

A floppy disk, hard disk, optical disk, magneto-optical disk, CD-ROM, CD-R, magnetic tape, nonvolatile memory card, ROM, etc. can be used as the storage media for supplying program codes.

The present invention can also be applied to the case where the functions of the above-described embodiments by executing the program codes read out by the computer, and further to the case where, based on the instruction of the above-described program codes, OS (operating system) or the like running under the computer performs a portion or all of actual processing, and the functions of the above-described embodiments are achieved by this processing.

Moreover, the present invention can also be applied to the case where the program codes read out from the storage medium are written into memory provided a function expansion unit connected to a function expansion board or the computer, and then based on the instruction of the program codes, CPU or the like provided in the function expansion board or the function expansion unit performs a portion or all of actual processing, and the functions of the above-described embodiments are achieved by this processing.

When applying the present invention to the above-described storage medium, for example, program codes corresponding to the flowcharts shown in FIGS. 7, 8, and 10 are stored.

As is evident from the foregoing, for predetermined areas where different kinds of inks are discharged, when the respective imparting amounts of the plurality of different kinds of inks exceed the respective predetermined amounts, printing with respect to the predetermined area is performed in the unidirectional print mode (print by one of the advance scanning and the return scanning) instead of performing in the bidirectional print mode (print by both the advance scanning and the return scanning). Thereby, with regard to the above-described mutually different kinds of inks, printing by using ink imparting amounts exceeding the above-described predetermined amount can be prevented from being performed by the bidirectional scanning. This allows uneven colors (uneven densities) caused by discharge time difference, which would occur in a bidirectional printing, to be eliminated.

As a consequence, it is possible to eliminate uneven densities due to bidirectional scanning of the print heads, particularly uneven densities at both ends in the main scanning direction in one band, without significantly reducing an overall printing speed, thereby allowing high image-quality printing to be realized.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of following claims is to be accorded the broadest interpretation so as to encompass all such modifications and equivalent structures and functions.

What is claimed is:

1. An ink jet print apparatus capable of printing in a bidirectional printing mode wherein printing is performed on a print medium by both a main scan in an advance direction and a main scan in a return direction of print heads for discharging a plurality of different kinds of inks, and capable of printing in a unidirectional printing mode wherein printing is performed on the print medium by either the main scan in the advance direction or the main scan in the return direction of the print heads, the apparatus comprising:

acquiring means that, based on print data corresponding to a predetermined region on the print medium, acquires information of respective ink amounts to be imparted to the predetermined region for the plurality of different kinds of inks; and determining means that, based on the information acquired by said acquiring means, determines whether the respective imparting amounts of the plurality of different kinds of inks exceed respective predetermined amounts that have been predetermined corresponding to the respective inks, wherein, (a) when said determining means determines that the respective imparting amounts of all of the plurality of different kinds of inks exceed the respective predetermined amounts, printing with respect to the predetermined region is performed in the unidirectional print mode, and (b) when said determining means determines that at least one of the respective imparting amounts of the plurality of different kinds of inks does not exceed the predetermined amount thereof, printing with respect to the predetermined region is performed in the bidirectional print mode.

2. An ink jet print apparatus according to claim 1, further comprising time acquiring means that acquires the time required to scan a region including the predetermined region when said determining means determines that all of the imparting amounts of the plurality of different kinds of inks exceed the respective predetermined amounts, wherein, when the time acquired by said time acquiring means is not less than a predetermined time, printing with respect to the predetermined region is performed in the unidirectional printing mode.

3. An ink jet print apparatus according to claim 1 or 2, wherein the predetermined region is one of divided regions obtained by dividing, into a plurality of regions, the region on which printing can be performed by one scan of the nozzle columns of black and colors of the print heads, along a main scanning direction, wherein said determining means comprises dot number determining means that, with respect to at least one of the plurality of divided regions, determines whether the imparting amounts of all of the plurality of different kinds of inks exceed the respective predetermined amounts; and area number determining means that determines whether the number of the areas to which the respective imparting amounts have been determined to exceed the respective predetermined amounts, exceeds a predetermined number, and wherein, when the area number determining means determines that the area number exceeds the predetermined number, printing with respect to the predetermined area is performed in the unidirectional print mode.

4. An ink jet print apparatus according to claim 3, further comprising monochrome/color determining means that determines, based on print data, whether the print data is monochrome print data or color print data, wherein, when the print data is monochrome print data, imparting amount determination by the dot number determination means for each divided region, and area number determination by the area number determining means are skipped.

5. An ink jet print apparatus according to claim 3, wherein the dot number determining means performs determination with respect to only divided areas positioned at both end portions among the plurality of divided areas.

6. An ink jet print apparatus according to claim 1, wherein the plurality of different kinds of inks are black ink and color inks other than the black ink.

7. An ink jet print apparatus according to claim 1, wherein the predetermined amount used in the determination by said determining means varies depending on the kind of print medium to be used.

8. An ink jet printing method wherein printing is performed in any one of a bidirectional printing mode in which printing is performed on a print medium by both a main scan in an advance direction and a main scan in a return direction of print heads for discharging a plurality of different kinds of inks, and a unidirectional printing mode in high printing is performed on the print medium by either the main scan in the advance direction or that in the return direction of the print heads, the method comprising the steps of:

acquiring, based on print data corresponding to a predetermined area on the print medium, information of respective ink amounts to be imparted to the predetermined area for the plurality of different kinds of inks; and determining, based on the information acquired in said acquiring step, whether the respective imparting amounts of the plurality of different kinds of inks exceed respective predetermined amounts that have been predetermined corresponding to the respective inks, wherein, in said determining step:

(a) when it is determined that the respective imparting amounts of all of the plurality of different kinds of inks exceed the respective predetermined amounts, printing with respect to the predetermined area is performed in the unidirectional print mode; and (b) when it is determined that at least one of the respective imparting amounts of the plurality of different kinds of inks does not exceed the predetermined amount thereof, printing with respect to the predetermined area is performed in the bidirectional print mode.

9. An ink jet printing method according to claim 8, further comprising the step of acquiring the time required to scan a region including the predetermined region when, in said determining step, it is determined that the imparting amounts of all of the plurality of different kinds of inks exceed the respective predetermined amounts, wherein, when the time acquired in said time acquiring step is not less than a predetermined time, printing with respect to the predetermined area is performed in the unidirectional printing mode.

10. An ink jet printing method according to claim 8 or 9, wherein the predetermined area is one of divided regions obtained by dividing, into a plurality of regions, the region on which printing can be performed by one scan of the nozzle columns of black and colors of the print heads, along the main scanning direction, wherein said determining step comprises a dot number determining step, of determining, with respect to at least one of the plurality of divided regions, whether the imparting amounts of all of the plurality of different kinds of inks exceed the respective predetermined amounts; and an area number determining step, of determining whether the number of the areas to which the respective imparting amounts have been determined to exceed the respective predetermined amounts, exceed the predetermined number, and wherein, when, in the area number determining step, it is determined that the area number exceeds the predetermined number, printing with respect to the predetermined area is performed in the unidirectional print mode.

11. An ink jet printing method according to claim 10, further comprising a monochrome/color determining step, of determining, based on print data, whether the print data is monochrome print data or color print data, wherein, when the print data is monochrome print data, said dot number determination step for each divided area, and said area number determining step are skipped.

12. An ink jet printing method according to claim 10, wherein the determination in said dot number determining step is made only with respect to divided areas positioned at both end portions among the plurality of divided areas.

13. An ink jet printing method according to claim 8, wherein the plurality of different kinds of inks are black ink and color inks other than the black ink.

14. An ink jet printing method according to claim 8, wherein the predetermined amount used in the determination in said determining step varies depending on the kind of print medium to be used.

15. A control program for controlling an ink jet print apparatus that performs printing on a print medium using print heads for discharging a plurality of different kinds of inks, the program comprising the steps of:

acquiring, based on print data corresponding to a predetermined area on the print medium, information of respective ink amounts to be imparted to the predetermined area for the plurality of different kinds of inks; and determining, based on the information acquired in said acquiring step, whether the respective imparting amounts of the plurality of different kinds of inks exceed respective predetermined amounts that have been predetermined corresponding to the respective inks, wherein, in said determining step:

(a) when it is determined that the respective imparting amounts of all of the plurality of different kinds of inks exceed the respective predetermined amounts, a unidirectional print mode, wherein printing is performed by either a main scan in an advance direction or a main scan in a return direction of the print heads, is selected; and (b) when it is determined that at least one of the respective imparting amounts of the plurality of different kinds of inks does not exceed the predetermined amount thereof, a bidirectional print mode, wherein printing is performed by both the main scan in the advance direction and the main scan in the return direction of the print heads, is selected.

16. A computer-readable storage medium that stores the control program according to claim 15.

17. An ink jet printing method wherein printing is performed in any one of a bidirectional printing mode in which printing is performed on a print medium by both a main scan in an advance direction and a main scan in a return direction of print heads for discharging a plurality of different kinds of inks, and a unidirectional printing mode in which printing is performed on the print medium by one of the main scan in the advance direction and the main scan in the return direction of the print heads, the method comprising the steps of:

acquiring, based on print data corresponding to the predetermined area on the print medium, information of respective ink amounts to be imparted to the predetermined area for the plurality of different kinds of inks;

determining, based on the information acquired in said acquiring step, whether the respective imparting amounts of the plurality of different kinds of inks exceed respective predetermined amounts that have been predetermined corresponding to the respective inks; and switching a print mode to be used from the bidirectional print mode to the unidirectional print mode when, in said determining step, it is determined that the respective imparting amounts of all of the plurality of different kinds of inks exceed the respective predetermined amounts.

* * * * *

UNITED STATES PATENT AND TRADEMARK OFFICE

CERTIFICATE OF CORRECTION

PATENT NO. : 6,669,331 B2
DATED : December 30, 2003
INVENTOR(S) : Minoru Teshigawara et al.

It is certified that error appears in the above-identified patent and that said Letters Patent is hereby corrected as shown below:

Title page,
Insert Item:
-- [74] *Attorney, Agent or Firm*—Fitzpatrick, Cella, Harper & Scinto --.

Signed and Sealed this

Thirteenth Day of July, 2004

JON W. DUDAS
*Acting Director of the United States Patent and Trademark Office*